United States Patent [19]

Ohkawa et al.

[11] Patent Number: 4,957,078

[45] Date of Patent: Sep. 18, 1990

[54] V-TYPE MULTI-CYLINDER ENGINE

[75] Inventors: Tsuyoshi Ohkawa; Reiichi Kaji, both of Iwata, Japan

[73] Assignee: Yamaha Katsudoki Kabushiki Kaisha, Iwata, Japan

[21] Appl. No.: 382,093

[22] Filed: Jul. 19, 1989

[30] Foreign Application Priority Data

Jul. 22, 1988 [JP] Japan ..... 63-181478

[51] Int. Cl.[5] ..... F01L 1/02

[52] U.S. Cl. ..... 123/90.31

[58] Field of Search ..... 123/90.27, 90.31

[56] References Cited

U.S. PATENT DOCUMENTS

| | | | |
|---|---|---|---|
| 3,732,745 | 5/1973 | Jackson | 123/90.31 |
| 3,732,855 | 5/1973 | Jackson | 123/90.31 |
| 4,617,882 | 10/1986 | Matsumoto | 123/90.31 |
| 4,633,826 | 1/1987 | Tominaga et al. | 123/90.31 |
| 4,671,223 | 6/1987 | Asano et al. | 123/90.31 |

FOREIGN PATENT DOCUMENTS

| | | | |
|---|---|---|---|
| 0219803 | 9/1988 | Japan | 123/90.31 |

*Primary Examiner*—Charles J. Myhre
*Assistant Examiner*—Weilun Lo
*Attorney, Agent, or Firm*—Ernest A. Beutler

[57] ABSTRACT

An internal combustion engine having a V-type configuration with a camshaft disposed in the valley of the V and driven by an intermediate shaft that is offset to one side of the engine in the area of stagger between the cylinder banks. A gear train drives the intermediate shaft from the crankshaft and the camshaft from the intermediate shaft and provides a total gear reduction of one-half to one so that the camshaft rotates at one-half crankshaft speed. The engine is employed to operate a garden tractor having a lawn mower attachment.

22 Claims, 4 Drawing Sheets

V-TYPE MULTI-CYLINDER ENGINE

BACKGROUND OF THE INVENTION

This invention relates to a V-type, multi-cylinder engine and more particularly to a camshaft driving arrangement for an engine.

As is well known, the valves of a four-cycle internal combustion engine are normally operated by means of a camshaft which is driven at one-half of the crankshaft speed. In many forms of engine, the camshaft axis is disposed adjacent the crankshaft axis and the camshaft operates the valves through push rods and other forms of mechanisms. In connection with such an arrangement, it is desirable in order to keep the engine as compact as possible to position the camshaft as close as possible to the crankshaft. However, with this type of arrangement, the camshaft is normally driven from the crankshaft by a single gear train and in order to obtain the necessary speed reduction, the size of the gears becomes quite large.

It is, therefore, a principal object of this invention to provide an improved and compact camshaft drive arrangement for an internal combustion engine.

It is a further object of this invention to provide a camshaft drive arrangement for an engine which permits the camshaft to rotate about an axis that is disposed closely adjacent the crankshaft axis but nevertheless is driven at one-half crankshaft speed.

When the engine is provided with banks of cylinders, the engine can be made much simpler if the valves associated with the cylinders of all cylinder banks are driven from a single camshaft. To enable this type of arrangement, it is the normal practice to place the camshaft in the valley between the cylinder banks and at the base of this valley. For reasons previously noted, the type of camshaft drives previously employed for rotating the camshaft at one-half crankshaft speed add to the bulk of the engine and dictate the actual location of the camshaft.

It is, therefore, a still further object of this invention to provide a more compact arrangement for driving a camshaft in a V-type engine.

It is a further object of this invention to provide a camshaft drive arrangement for a V-type engine wherein the length of the engine can be reduced and the compactness of it also improved.

SUMMARY OF THE INVENTION

A first feature of this invention is adapted to be embodied in an internal combustion engine having a cylinder and a crankshaft at one end of the cylinder that is rotatably driven from a piston reciprocating in the cylinder. A camshaft is supported for rotation about an axis offset from the axis of rotation of the crankshaft. Cam means on the camshaft operate at least one valve associated with the cylinder. An intermediate shaft is journaled for rotation about an axis parallel to and offset from the crankshaft and camshaft axes. A first pair of gears are positioned on the crankshaft and intermediate shaft, respectively, for driving the intermediate shaft from the crankshaft. A second pair of gears are positioned respectively on the intermediate shaft and the camshaft for driving the camshaft from the intermediate shaft. The ratio of the first and second pairs of gears is other than unity and the combined ratio is equal to one-half to one so that the camshaft will be driven at one-half of crankshaft speed.

Another feature of this invention is adapted to be embodied in an internal combustion engine having banks of angularly disposed cylinders. Pistons are supported in the cylinders and drive a single crankshaft by way of connecting rods that are journaled in side-by-side relationship on the crankshaft. As a result, the cylinders are staggered with respect to each other. A camshaft is disposed in the area between the cylinder banks and operates valves associated with each of the cylinders. An intermediate shaft is disposed adjacent one end of one of the cylinder banks and is driven from the crankshaft. The camshaft is driven from this intermediate shaft. The drive means for the intermediate shaft is positioned in the area of stagger between the cylinder banks so as to decrease the overall length of the engine.

DETAILED DESCRIPTION OF THE PREFERRED EMBODIMENT

Figure 1:
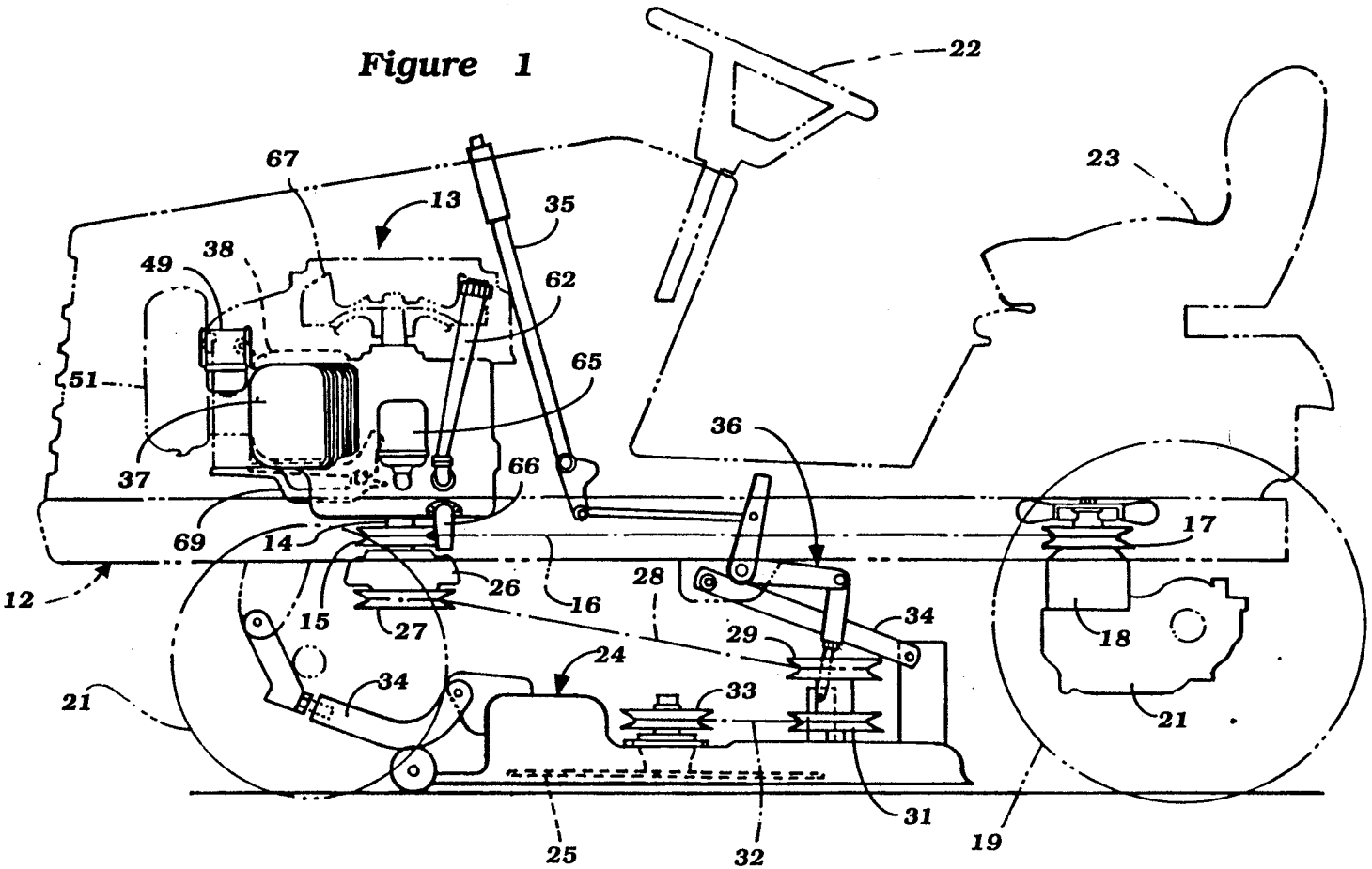
FIG. 1 is a side elevational view of a tractor powered by an internal combustion engine constructed in accordance with an embodiment of the invention and driving a lawn mower attachment.
Figure 2:
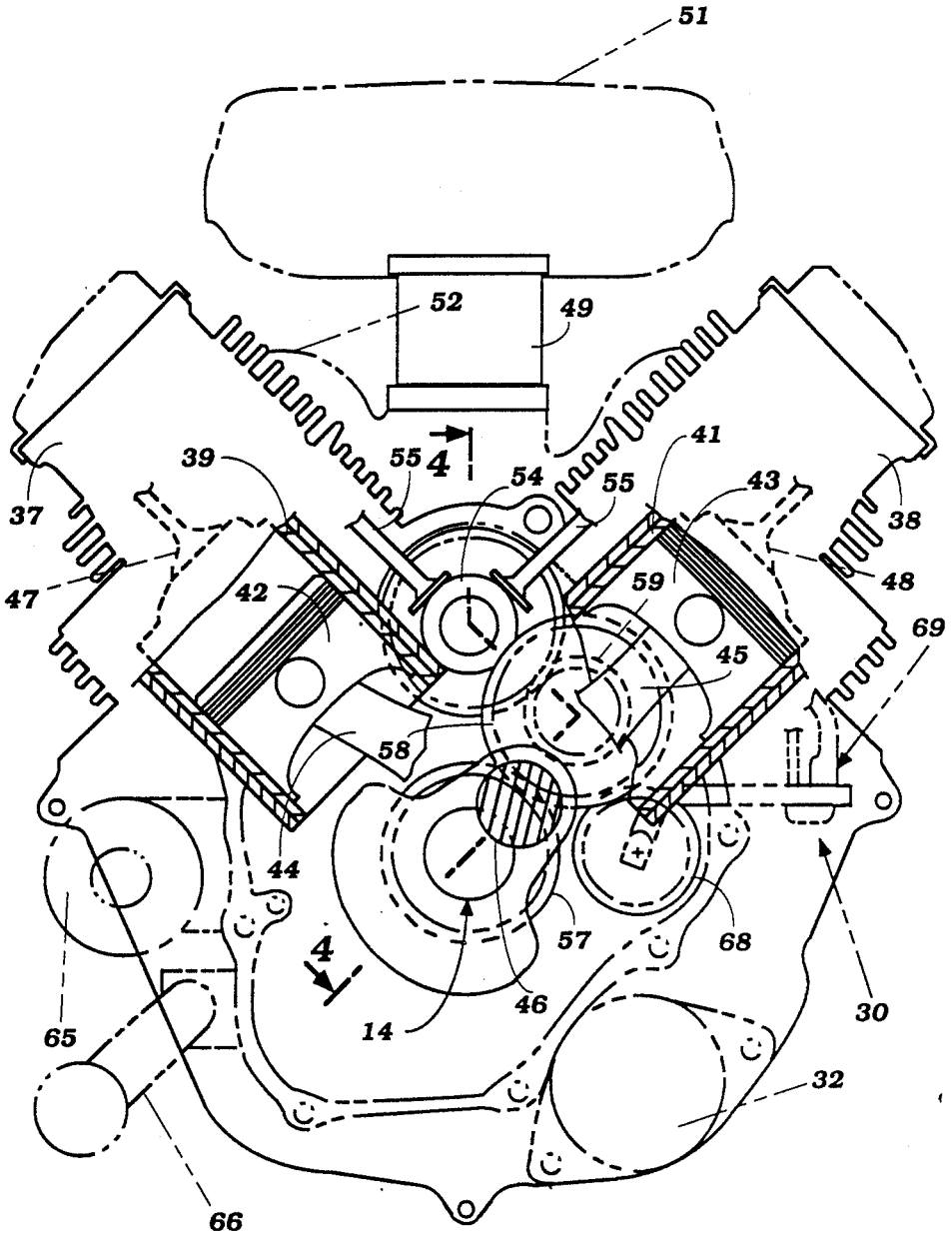
FIG. 2 is a top plan view of the engine associated with the tractor on an enlarged scale and with portions broken away and other portions shown in phantom.

Referring first to FIG. 1, a small garden tractor or riding lawn mower powered by an internal combustion engine constructed in accordance with an embodiment of the invention is identified generally by the reference numeral 11. Since the invention relates primarily to the powering engine of the garden tractor 11, certain components of the garden tractor 11 have been shown in phantom so as to more clearly reveal the construction and operation of the invention.

The tractor 11 includes a frame assembly 12 that mounts an internal combustion engine 13 which, in the illustrated embodiment, is comprised of a V2, air-cooled, four-cycle engine. It is to be understood, however, that the invention has utility with engines having other numbers of cylinders but it has particular utility in conjunction with V type of engines having staggered cylinder banks, for a reason which will become apparent.

The engine 13 is disposed in the frame 12 with its output or crankshaft 14 rotating about a vertically extending axis and driving a first pulley 15 that is positioned beneath the engine 13. The pulley 15 drives a drive belt 16 which, in turn, drives a driven pulley 17 affixed to the input shaft of a hydrostatic transmission 18. The hydrostatic transmission 18 drives a pair of rear wheels 19 by means of a final drive assembly 21.

A pair of dirigible front wheels 21 are supported at the front of the frame assembly 12 in a known manner and are steered by means of a steering wheel 22 that is positioned forwardly of a rider's seat 23 carried to the rear of the frame 12.

The tractor 12 is shown associated with a lawn mower type of accessory, indicated generally by the reference numeral 24, and which is comprised of a cutting blade 25. The cutting blade 25 is driven from the engine output shaft 14 selectively through an electrically operated clutch 26 which couples a second driving pulley 27 to the engine output shaft 14. The driving pulley 27 drives a drive belt 28 that drives a first pulley 29 of the mower attachment 24. A second pulley 31 rotates with the driven pulley 29 and drives a drive belt 32 and pulley 33 that is affixed to the cutter shaft 25.

The mower 24 is supported for vertical movement relative to the frame 12 by means of a pair of parallel linkage systems 34. The height of the mower and the linkage systems 34 is controlled by a control lever 35 that is connected by a linkage system 36 to the mower housing in a suitable manner.

The aforedescribed construction is that of a typical environment in which the invention can be utilized. It is to be understood, however, that the invention can be utilized in conjunction with many other applications for internal combustion engines having angularly disposed cylinder banks.

Referring now in detail to the remaining figures in addition to FIG. 1, the construction of the engine 13 will be described. As has been noted, the engine 13 is of the V type and includes a left hand cylinder bank 37 and a right hand cylinder bank 38. The cylinder banks 37 and 38 are each formed with respective cylinder bores that are defined by liners 39 and 41. In the illustrated embodiment, the engine is of the V2 type and to this end the cylinder liners 39 and 41 and cylinder banks 37 and 38 are disposed at a right angle to each other. It should be understood by those skilled in the art that the invention can be utilized in conjunction with engines having other than two cylinders and wherein the cylinder banks are disposed at other than right angles.

Figure 3:
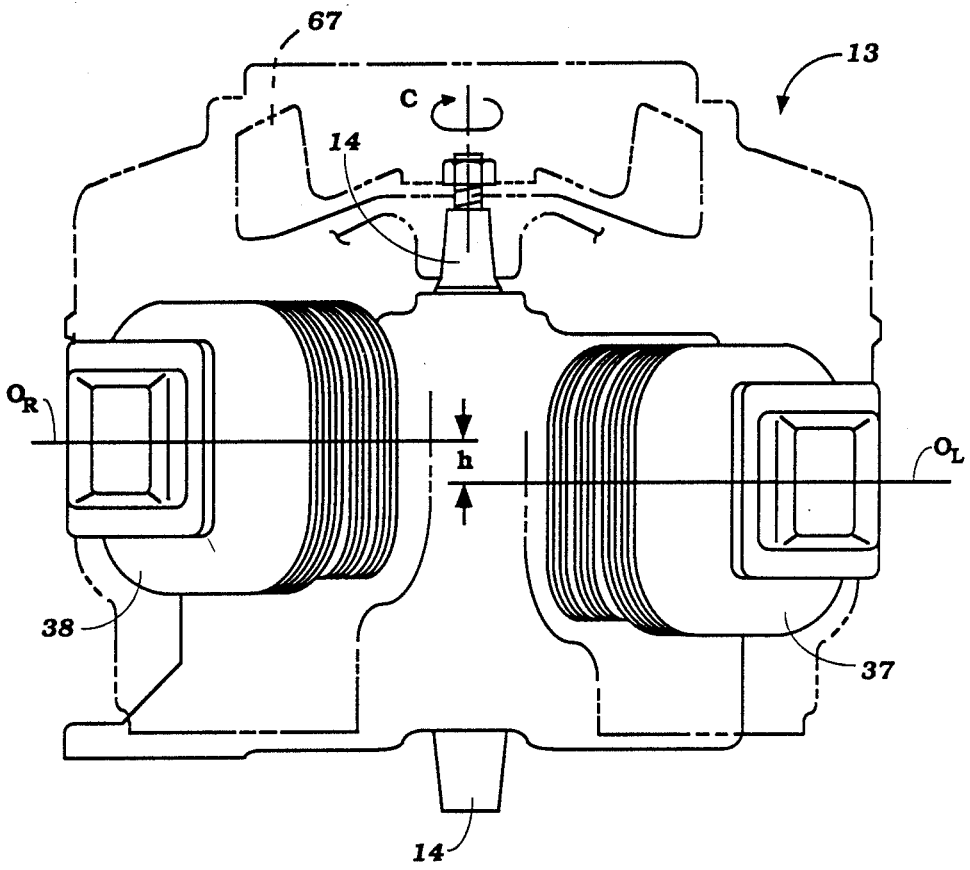
FIG. 3 is a front elevational view of the engine.
Figure 4:
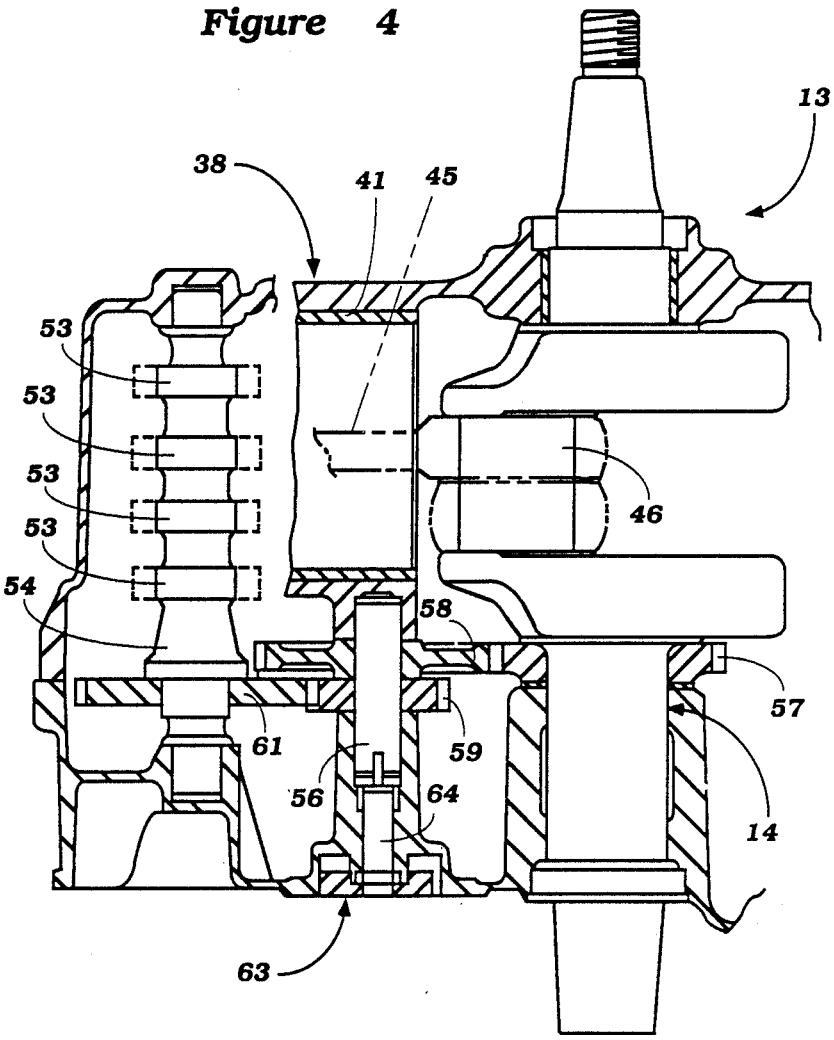
FIG. 4 is a cross-sectional view taken along the line 4—4 of FIG. 2.

Pistons 42 and 43 are reciprocally supported in the cylinder liners 39 and 41, respectively, and are connected by means of connecting rods 44 and 45 to a single journal or throw 46 of the crankshaft 14. In order to permit this side-by-side relationship, the centerlines of the bores defined by the cylinder liners 39 and 41, indicated by the lines $O_R$ and $O_L$, respectively, in FIG. 3, are staggered or offset by a distance h.

Intake valves 47 and 48 are supported within the heads of the cylinders banks 37 and 38 and control the admission of an intake charge to the cylinder bores. This intake charge is generated by a carburetor 49 which draws air through an air cleaner and silencer 51 and discharges it into the intake ports of the respective cylinder banks 37 and 38 through a manifold 52.

In a like manner, there are provided exhaust valves (not shown) in the cylinder heads for controlling the flow of the burnt charge from the cylinder liners 39 and 41 to an exhaust manifold (not shown) and an appropriate exhaust system.

The intake valves 47 and 48 and exhaust valves are all operated from individual lobes 53 formed on a camshaft 54 which is journaled for rotation in an appropriate manner at the valley of the V between the cylinder banks 37 and 38. Because of the unique camshaft drive arrangement, which will be described, it is possible to place the rotational axis of the camshaft 54 quite close to the rotational axis of the crankshaft 14. These rotational axes are parallel to each other.

The cam lobes 53 operate the valves through a series of push rods 55 that are suitably supported in the cylinder banks 37 and 38 on the sides toward the V of the cylinder banks and rocker arms (not shown) in a well known manner.

As is also well known, the camshaft 54 should rotate at one-half crankshaft speed since the engine operates on the four-stroke cycle principle. With conventional cam drive arrangements, this speed reduction is achieved in a single gear set which requires the use of relatively large gears and which requires, therefore, the rotational axis of the camshaft 54 to be spaced more widely from the crankshaft axis 14 than with this construction.

In accordance with the invention, an intermediate shaft 56 is journaled in the cylinder bank 38 which is offset from the cylinder bank 37 and rotates about an axis that is parallel to the axis of rotation of the camshaft 54 and the crankshaft 14. This rotational axis of the shaft 56 intersects the bore of the cylinder liner 41 and thus is clearly offset to one side of the engine. The intermediate shaft 56 is driven from the crankshaft 14 by a first gear pair that is comprised of a timing gear 57 that is affixed for rotation with the crankshaft 14 and an intermeshing driven gear 58 that is affixed to the shaft 56. The gear 58 is positioned within the offset area h between the lower ends of the cylinder banks 37 and 38 so as to permit a compact assembly.

A second gear pair comprised of a driving gear 59 fixed to the intermediate shaft 56 and a driven gear 61 fixed to the camshaft 54 drives the camshaft 54 from the intermediate shaft 56. It should be noted that the ratio of the gear pairs 57 and 58 and 59 and 61 is other than unity but also other than one-half to one. However, the combined ratios of the gear pairs 57, 58 and 59, 61 is such that the overall drive ratio is one-half to one so that the camshaft 54 will be driven at one-half the rotational speed of the crankshaft 14. However, because of the use of the two gear sets and the staggering of them as is possible because the staggering of the cylinder banks, the engine need not be elongated in the direction of the crankshaft axis. Furthermore, as noted above, it is possible to place the rotational axis of the camshaft 54 quite close to the rotational axis of the crankshaft 14.

The engine 13 is further provided with a lubricating system that includes a lubricant reservoir within the crankcase of the engine and which can be filled through a fill pipe 62. Lubricant is circulated through the engine by means of a lubricant pump 63 that is driven off the intermediate shaft 56 by a oil pump drive shaft 64. The lubricant is then passed through a filter 65 and circulated through the engine in any suitable fashion and along any suitable path. The lubricant may be drained from the system through a drain 66 for periodic servicing.

In the illustrated embodiment, the engine is air cooled and to this end there is provided a cooling fan 67 that is driven from the upper end of the crankshaft 14 and which circulates air around the engine. Any suitable shrouding may be further provided so as to assist in this lubrication.

The speed control for the engine 13 may be a govern control of the type shown in the copending application entitled "Governor For Vertical V-Type Engine", Ser. No. 382,091, filed July 19, 1989 in the name of Kiyohiko Oguri and assigned to the assignee of this application. The governor mechanism generally includes a speed responsive unit 68 that is driven from the intermediate shaft via the gear 58 and which operates the throttle linkage of the carburetor 49 through a linkage assembly, indicated generally by the reference numeral 69, and which is described in more detail in the aforenoted copending application, the disclosure of which is incorporated herein by reference.

It should be readily apparent from the foregoing description that the camshaft drive mechanism permits a very compact engine construction. It is also to be understood that the foregoing description is that of a preferred embodiment of the invention and that various changes and modifications may be made without departing from the spirit and scope of the invention, as defined by the appended claims.

We claim:

1. An internal combustion engine having a cylinder, a crankshaft at one end of said cylinder rotatably driven from a piston reciprocating in said cylinder, a camshaft rotatable about an axis offset from the axis of rotation of said crankshaft, cam means on said camshaft for operating a valve associated with said cylinder, an intermediate shaft journaled for rotation about an axis parallel to and offset from said crankshaft and said camshaft axes, a first pair of gears comprising a gear fixed for rotation with said crankshaft and a gear meshed therewith and affixed for rotation with said intermediate shaft for driving said intermediate shaft from said crankshaft, and a second pair of gears comprising a gear fixed for rotation with said intermediate shaft and a gear meshed therewith and fixed for rotation with said camshaft for driving said camshaft from said intermediate shaft, said first pair of gears and said second pair of gears each having a ratio other than unity and other than one-half to one with the overall ratio of rotation of said camshaft to said crankshaft being one-half to one.

2. An internal combustion engine as set forth in claim 1 wherein the intermediate shaft axis intersects the bore of the cylinder.

3. An internal combustion engine as set forth in claim 2 wherein the camshaft axis is offset to one side of the cylinder.

4. An internal combustion engine as set forth in claim 3 wherein the first pair of gears is located at one end of the engine.

5. An internal combustion engine as set forth in claim 4 wherein both pair of gears are located at the same end of the engine.

6. An internal combustion engine as set forth in claim 1 wherein the first pair of gears is located at one end of the engine.

7. An internal combustion engine as set forth in claim 6 wherein both pair of gears are located at the same end of the engine.

8. An internal combustion engine as set forth in claim 1 further including a second cylinder disposed at an angle to the first mentioned cylinder and having a piston for driving the crankshaft, the camshaft having further cam means for operating a valve associated with the other cylinder.

9. An internal combustion engine as set forth in claim 8 wherein the axis of rotation of the intermediate shaft intersects the bore of the first mentioned cylinder.

10. An internal combustion engine as set forth in claim 9 wherein the camshaft is positioned in the valley between the cylinders.

11. An internal combustion engine as set forth in claim 10 wherein the first pair of gears is disposed at one end of the engine.

12. An internal combustion engine as set froth in claim 11 wherein the cylinders are staggered relative to each other and the first pair of gears are disposed within a recess formed at one end of the engine due to the stagger between the cylinders.

13. An internal combustion engine having first and second cylinder banks disposed at an angle to each other, a crankshaft driven by pistons reciprocating within said cylinders, a camshaft rotatable about an axis offset from the axis of rotation of said crankshaft and disposed in the area between the banks of cylinders, cam means on said camshaft for operating valves associated with said cylinders, an intermediate shaft journaled for rotation about an axis parallel to and offset from the axes of said camshaft and said crankshaft, said cylinders being staggered relative to each other and in the direction of the crankshaft axis, a first pair of gears disposed within the recess formed at one end of the engine due to stagger between the cylinders for driving the intermediate shaft from the crankshaft, and a second pair of gears for driving the camshaft from the intermediate shaft.

14. An internal combustion engine as set forth in claim 13 wherein the first pair of gears and the second pair of gears are disposed at the same end of the engine.

15. An internal combustion engine and a pair of angularly related cylinder banks each having a cylinder, a crankshaft at one end of said cylinders rotatably driven from a piston reciprocating in the respective of said cylinders, a camshaft rotatable about an axis offset from the axis of rotation of said crankshaft and in a valley formed between said cylinder banks, cam means on said camshaft for operating valves associated with each of said cylinders, an intermediate shaft journaled for rotation about an axis parallel to and offset from said crankshaft and said camshaft axes, a first pair of gears and said second pair of gears each having a ratio other than unity and other than one-half to one with overall ratio of rotation of said camshaft to said crankshaft being one-half to one.

16. An internal combustion engine as set forth in claim 15 wherein the intermediate shaft axis intersects the bore of one of the cylinders.

17. An internal combustion engine as set forth in claim 16 wherein the first pair of gears is located at one end of the engine.

18. An internal combustion engine as set forth in claim 17 wherein both pair of gears are located at the same end of the engine.

19. An internal combustion engine as set forth in claim 15 wherein the first pair of gears is located at one end of the engine.

20. An internal combustion engine as set forth in claim 19 wherein both pair of gears are located at the same end of the engine.

21. An internal combustion engine as set forth in claim 15 wherein the cylinder banks are staggered relative to each other and the first pair of gears are disposed within a recess formed at one end of the engine due to the stagger between the cylinders.

22. An internal combustion engine as set forth in claim 15 wherein the gear fixed for rotation with the crankshaft and the gear fixed for rotation with the camshaft do not have a two to one ratio relative to each other.

* * * * *